United States Patent [19]

Sugata et al.

[11] Patent Number: 4,954,405

[45] Date of Patent: Sep. 4, 1990

[54] PHOTOCONDUCTOR FOR ELECTROPHOTOGRAPHY COMPRISING SQUARYLIUM CONTAINING GENERATOR LAYER AND HYDRAZONE CONTAINING TRANSPORT LAYER

[75] Inventors: Yoshinobu Sugata; Noboru Furusho; Tomomi Tanaka, all of Kawasaki, Japan

[73] Assignee: Fuji Electric Co., Ltd., Kanagawa, Japan

[21] Appl. No.: 373,684

[22] Filed: Jun. 28, 1989

[30] Foreign Application Priority Data

Jun. 30, 1988 [JP] Japan ..... 63-163017

[51] Int. Cl.[5] ..... G03G 5/14

[52] U.S. Cl. ..... 430/58; 430/59

[58] Field of Search ..... 430/58, 59

[56] References Cited

U.S. PATENT DOCUMENTS

| | | | |
|---|---|---|---|
| 3,484,237 | 12/1969 | Shattuck et al. | 96/1.5 |
| 4,150,987 | 4/1979 | Anderson | 430/59 |
| 4,278,747 | 7/1981 | Murayama et al. | 430/82 |
| 4,353,971 | 10/1982 | Chang | 430/58 |
| 4,367,273 | 1/1983 | Murayama et al. | 430/56 |
| 4,385,106 | 10/1983 | Sakai . | |
| 4,415,640 | 11/1983 | Goto et al. | 430/59 |
| 4,448,868 | 11/1984 | Suzuki et al. . | |
| 4,565,761 | 2/1986 | Katagiri et al. . | |
| 4,568,623 | 2/1986 | Makino et al. | 430/58 |
| 4,606,986 | 8/1986 | Yanusa et al. | 430/59 |
| 4,624,904 | 11/1986 | Kazmaier et al. | 430/59 |
| 4,629,670 | 3/1986 | Katagiri et al. . | |
| 4,666,809 | 5/1987 | Matsumoto et al. | 430/76 |
| 4,673,630 | 9/1987 | Katagiri et al. . | |
| 4,677,045 | 6/1987 | Champ et al. | 430/76 |
| 4,702,983 | 10/1987 | Haino et al. | 430/75 |
| 4,731,315 | 2/1988 | Horie et al. | 430/77 |
| 4,783,387 | 11/1988 | Ueda | 430/76 |
| 4,808,503 | 2/1989 | Yamada et al. | 430/75 |
| 4,839,252 | 2/1989 | Murata et al. . | |
| 4,861,691 | 1/1989 | Kuroda et al. . | |
| 4,861,692 | 6/1989 | Kuroda et al. . | |

FOREIGN PATENT DOCUMENTS

| | | |
|---|---|---|
| 0131140 | 1/1985 | European Pat. Off. . |
| 3019909 | 11/1980 | Fed. Rep. of Germany . |
| 3141306 | 6/1982 | Fed. Rep. of Germany . |
| 3139524 | 8/1982 | Fed. Rep. of Germany . |
| 3203621 | 9/1982 | Fed. Rep. of Germany . |
| 3303830 | 8/1983 | Fed. Rep. of Germany . |
| 47-37543 | 4/1972 | Japan . |
| 47-10785 | 6/1972 | Japan . |
| 39952 | 4/1975 | Japan . |
| 50445 | 3/1984 | Japan . |
| 59-182456 | 3/1984 | Japan . |
| 59-182457 | 7/1984 | Japan . |
| 93443 | 5/1985 | Japan . |
| 264055 | 11/1987 | Japan . |

*Primary Examiner*—J. David Welsh

*Attorney, Agent, or Firm*—Spencer & Frank

[57] ABSTRACT

A photoconductor for electrophotography comprises an electrically conductive substrate and a laminate formed on the substrate. The laminate includes a charge generating layer including a specific squarylium compound as a charge generating substance and a charge transporting layer including a hydrazone compound. One type of the specific squarylium compound is represented by the following general formula.

Wherein, each of R1, R2, R5 and R6 stands for one of an alkyl group, an aralkyl group and alkenyl group, each of which groups may be or not may be substituted, or R1, forms a ring together with R2, R5 forms a ring together with R6, each of R3 and R4 stands for one of hydrogen atom, a halogen atom, a hydroxy group, an alkyl group and an alkoxy group.

3 Claims, 1 Drawing Sheet

PHOTOCONDUCTOR FOR ELECTROPHOTOGRAPHY COMPRISING SQUARYLIUM CONTAINING GENERATOR LAYER AND HYDRAZONE CONTAINING TRANSPORT LAYER

BACKGROUND OF THE INVENTION

1. Field of the Invention

The present invention relates to photoconductors for electrophotography, and particularly to a laminate type photoconductor for electrophotography which comprises a charge generating layer including an organic charge generating substance and a charge transporting layer including an organic charge transporting substance, and a photoconductor which can be used in printers and copying apparatuses.

2. Description of the Prior Art

Photosensitive materials which have heretofore been used in photoconductors for electrophotography include inorganic photoconductive substances such as selenium and selenium alloys, dispersions of inorganic photoconductive substances such as zinc oxide and cadmium sulfide in resin binders, organic polymeric photoconductive substances such as poly-N-vinylcarbazole and polyvinylanthracene, organic photoconductive substances such as phthalocyanine compounds and disazo compounds, and dispersions of such organic polymeric photoconductive substances in resin binder and films of organic photoconductive substance as mentioned above, deposited by means of vacuum evaporation.

Photoconductors are required to have a function of maintaining a surface electric charge in the dark, a function of generating an electric charge upon receiving light, and a function of transporting an electric charge upon receiving light. They are classified into two types of photoconductors, namely so-called monolayer type photoconductors, and so-called laminate type photoconductors. The former comprises a single layer having all of the above-mentioned three functions, and the latter comprises functionally distinguishable laminated layers, one of which contributes mainly to the generation of electric charge, and another of which contributes to the retention of surface electric charge in the dark and the electric charge transportation upon receiving light. In an electrophotographic method using a photoconductor of the kind as mentioned above, for example, the Carlson's system is applied to image formation. The image formation according to this system comprises steps of subjecting a photoconductor in the dark to corona discharge to charge the photoconductor, exposing the surface of the charged photoconductor with imagewise light based on a manuscript or copy bearing, e.g., letters and/or pictures to form a latent electrostatic image, developing the formed latent electrostatic image with a toner, and transferring the developed toner image to a support such as a paper sheet to fix the toner image on the support. After the toner image transfer, the photoconductor is subjected to the steps of removal of the electric charge, removal of the remaining toner (cleaning), neutralization of the residual charge with light (erasion), and so on to be ready for reuse.

Photoconductors for electrophotograph in which use is made of an organic material(s) have recently been put into practical use by virtue of the advantageous feature(s) of flexibility, thermal stability, and/or a film forming capacity. They include a photoconductor comprising poly-N-vinylcarbazole and 2,4,7-trinitrofluoren-9-on (disclosed in U.S. Pat. No. 3,484,237), a photoconductor using an organic pigment as a main component (disclosed in Japanese Patent Laid-Open No. 37,543/1972), and a photoconductor using as a main component a eutectic complex composed of dye and a resin (disclosed in Japanese Patent Laid-Open No. 10,785/1972).

Although organic materials have many advantageous features mentioned above with which inorganic materials are not endowed, however, the fact is that there have been obtained no organic materials fully satisfying all the characteristics required of a material to be used in photoconductors for electrophotography at the present. Particular problems involved in organic materials have been concerned with photosensitivity and characteristics in continuous repeated use.

SUMMARY OF THE INVENTION

An object of the present invention is to provide a photoconductor for electrophotography for use in copying apparatuses and printers which photoconductor includes a novel organic material s not used to date as a charge generating substance and a charge transporting substance in the photosensitive layer, and has a high photosensitivity and excellent characteristics in repeated use.

The present invention provides a photoconductor for electrophotography comprising:

an electrically conductive substrate; and a laminate formed on the substrate and including a charge generating layer and a charge transporting layer;

the charge generating layer includes at least one squarylium compound represented by the following general formula (I) and/or (II), and the charge transporting layer includes a hydrazone compound as a charge transporting substance:

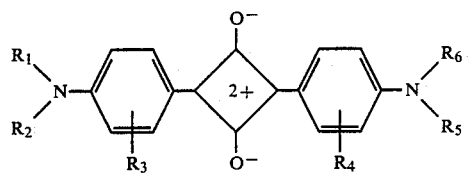

(I)

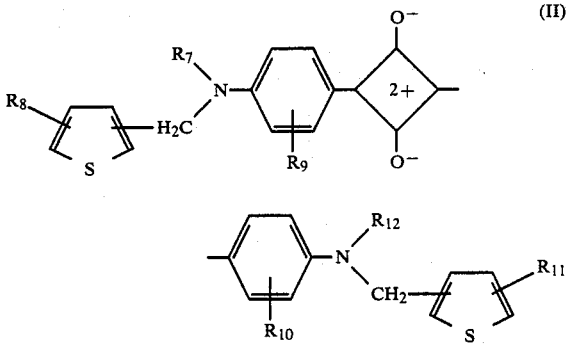

(II)

wherein, each of R1, R2, R5 and R6 stands for one of an alkyl group, an aralkyl group and alkenyl group, each of which groups may be or not may be substituted, or R1 forms a ring together with R2, R5 forms a ring together with R6, each of R3 and R4 stands for one of a hydrogen atom, a halogen atom, a hydroxy group, an alkyl group and an alkoxy group, each of R7 and R12 stands for one of an alkyl group, an aryl group, an aralkyl group, and an alkenyl group, each of which groups may be or not may be substituted, each of R8 and R11 for one of a hydrogen atom, a halogen atom, an alkyl group and an aryl group, both of which groups may be or not may be substituted, and each of R9 and R10 stands for one of hydrogen atom, a halogen atom, a hydroxy group, an alkyl group and an alkoxy group.

Here, the hydrazone compound may be represented by the following general formula (III):

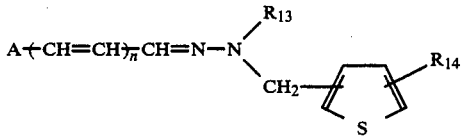

(III)

wherein, A stands for one of an aryl group and a hetelocyclic group, both of which may be or not may be substituted, R13 stands for one of an alkyl group and an aryl group, both of which may be or not may be substituted, R14 stands for one of a hydrogen atom, a halogen atom, an alkyl group and an aryl group, both of which groups may be or not may be substituted and n stands for one integer of 0 or 1.

The charge generating layer may be formed on the substrate and the charge transporting layer is formed on the charge generating layer.

The charge transporting layer may be formed on the substrate and the charge generating layer is formed on the charge transporting layer.

DETAILED DESCRIPTION OF PREFERRED EMBODIMENTS

Figure 1:
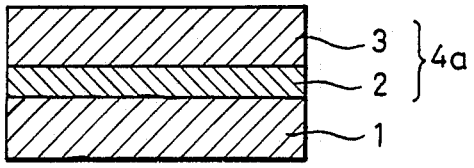
FIGS. 1 and 2 are schematic cross-sectional views of photoconductors according to the present invention.

FIGS. 1 and 3 are schematic cross-sectional views of different embodiments of the photoconductor of the present invention, respectively.

FIG. 1 shows a cross-sectional view of a laminate type photoconductor. A laminated photosensitive layer 2A is provided on an electroconductive substrate 1, a lower layer of the laminate is a charge generating layer 4 including a specific squarylium compound 3 as a charge generating substance 3 and an upper one is a charge transporting layer 6 containing a hydrazone compound as a charge transporting substance 5 as a main component, so that the photosensitive layer 2A functions as a photoconductor. The specific squarylium compounds and hydrazone compounds to be used in the present invention are explained later. This photoconductor is usually used according to the negative charge mode.

Figure 2:
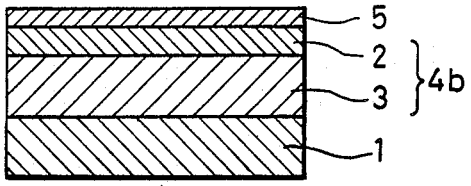

FIG. 2 shows a cross-sectional view of another laminate type photoconductor haing a layer structure in reverse to that of FIG. 1. A laminated photosensitive layer 2B is provided on an electroconductive substrate 1, a lower layer of the laminate is a charge transporting layer 6 and an upper one is a charge generating layer 4. The photosensitive layer also functions as a photoconductor. This photoconductor is usually used according to the positive charge mode. In this case, a covering layer 7 may generally be further provided as shown in FIG. 3 to protect the charge generating layer 4, but covering layer 7 is not essential.

A photoconductor as shown in FIG. 1 can be prepared by applying and drying a dispersion of a particulate charge generating substance in a solvent and/or a resin binder on an electroconductive substrate, followed by applying a solution of a charge transporting substance and a resin binder on the resulting layer and drying.

A photoconductor as shown in FIG. 2 can be prepared by applying and drying a solution of a charge transporting substance and a resin binder onto an electroconductive substrate, and coating and drying a dispersion of a particulate charge generating substance in a solvent and/or a resin binder onto the resulting coating layer, followed by formation of a covering layer.

The electroconductive substrate 1 serves as an electrode of the photoconductor and as a support for layer formed thereon. The electroconductive substrate may be in the form of cylinder, a plate or a film, and may be made of a metallic material such as aluminum, stainless steel or nickel, or other material having a surface treated to be electroconductive, such as glass so treated or a resin so treated.

The charge generating layer 4 is formed by application of a dispersion of a charge generating substance 3 in a resin binder, and this layer generates an electric charge upon receiving light. It is important that the charge generating layer 4 be high not only in charge generating efficiency but also in capability of injecting the generated electric charge into the charge transporting layer 6, which capability is desirably as little dependent upon the electric field as possible and high even in low intensity electric fields.

The thickness of the charge generating layer is determined depending on the extinction coefficient of a charge generating substance to be used therein in view of the layer's function of generating an electric charge, but is generally 5 μm or smaller, preferably 1 μm or smaller. It also is possible to form a charge generating layer using a charge generating substance as a main component in mixture with a charge transporting substance and so on. Resin binders usable in the charge generating layer include polycarbonates, polyesters, polyamides, polyurethanes, epoxy resins, silicone resins, and homopolymers and copolymers of methacrylic esters, which may be used either alone or in appropriate combination.

The charge transporting layer 6, which is formed by application of a solution or dispersion of an organic charge transporting substance in a resin binder, exhibits a function of serving as an insulating layer in the dark to retain an electric charge of the photoconductor as well as a function transporting an electric charge injected from the charge generating layer upon receiving light. Resin binders usable in the charge transporting layer include polycarbonates, polyesters, polyamides, polyurethanes, epoxy resins, silicone resins, and homopolymers and copolymers of methacrylic ester. It is important that the resin binders are stable in the mechanical, chemical and electrical properties and have a good adhesive properties as well as a compatibilities with the charge transporting substances.

The preferable thickness of the charge transporting layer for practically maintaining effective surface potentials is within the range from 3 μm to 5 μm, more preferably it is in the range from 5 μm to 20 μm.

The covering layer 7 is formed of a material having mechanical stress resistivity and chemical stability, and which has a function of receiving and retaining an electric charge generated by corona discharge in the dark and a capability of transmitting light to which the charge generating layer should respond. It is necessary that the covering layer 7 transmits light upon exposure of the photoconductor and allows the light to reach the charge generating layer, and then undergoes the injection of an electric charge generated in the charge generating layer to neutralize and erases a surface electric charge. From the viewpoint of the aforementioned description, it is desirable that the material to be used in the covering layer be as transparent as possible in the wavelength range wherein the charge generating substance attains maximum light absorption.

Materials usable in the covering layer include modified silicone resins such as acyl-modified silicone resins, epoxy-modified silicone resins, alkyd-modified silicone resins, polyester-modified silicone resins and urethane-modified silicone resins. Silicone resins as a hard coating agent are also usable. These modified silicone resins can be used individually, but mixtures of the modified silicone resins and condensates of metal alkoxy compounds, which can form a film mainly composed of SiO2, TiO2, INO3, or ZrO2, are preferably used to improve the durability of the photoconductor.

Although the thickness of the covering layer depends on the material or composition thereof, it can be arbitrarily set in so far as it does not produce any adverse effects including an increase in a residual potential in continuous repeated use.

In the charge generating layer 4, at least one squarylium compound represented by the following general formulae (I) and/or (II) as a charge generating substance.

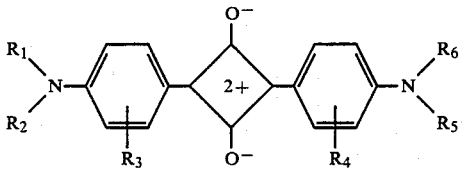

(I)

-continued

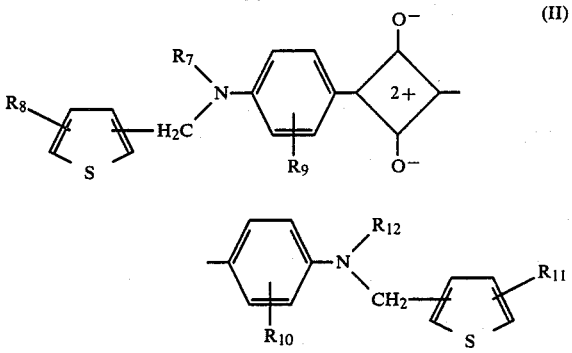

(II)

Wherein, each of R1, R2, R5 and R6 stands for one of an alkyl group, an aralkyl group and alkenyl group, each of which groups may be or not may be substituted, or R1 forms a ring together with R2, R5 forms a ring together with R6, each of R3 and R4 stands for one of a hydrogen atom, a halogen atom, a hydroxy group, an alkyl group and an alkoxy group, each of R7 and R12 stands for one of an alkyl group, an aryl group, an aralkyl group, and an alkenyl group, each of which groups may be or not may be substituted, each of R8 and R11 stands for one of a hydrogen atom, a halogen atom, an alkyl group and an aryl group, both of which groups may be or not may be substituted, and each of R9 and R10 stands for one of a hydrogen atom, a halogen atom, a hydroxy group, an alkyl group and an alkoxy group.

The squarylium compound represented by the general formula (I) and (II) are synthesized by, for example, dehydration reacting respective amino compounds represented by the following formula

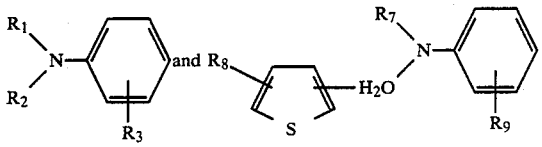

with 3,4-dihydroxy-3-cyclobuten-1, 2-dion in a suitable organic solvent such as a mixed solvent of 1-butanol and benzene.

The squarylium compound represented by the general formula (I) and to be used in the present invention include Compound No I-1

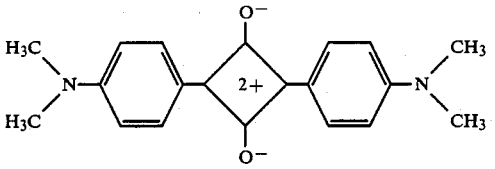

No I-2

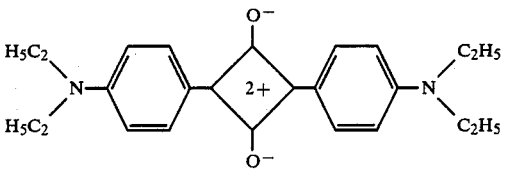

-continued
No I-3
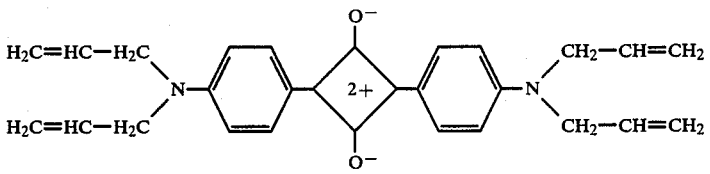
No I-4
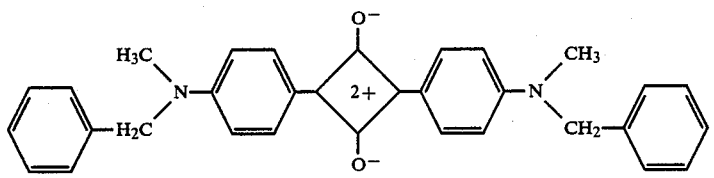
No I-5
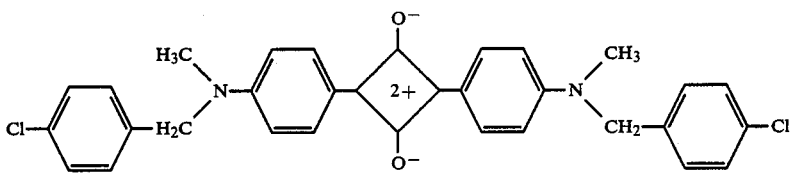
No I-6
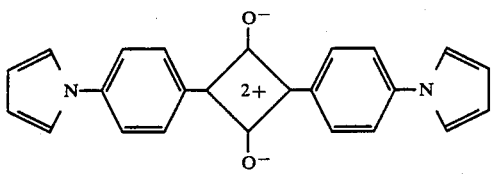
No I-7
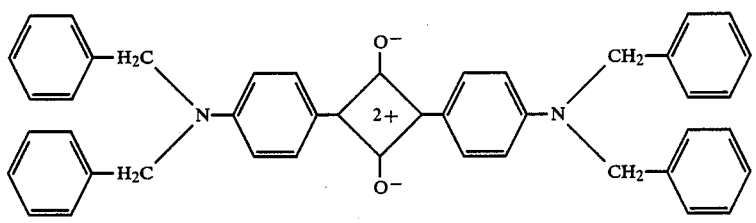
No I-8
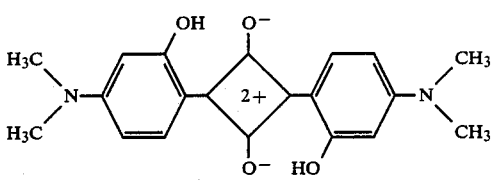
No I-9
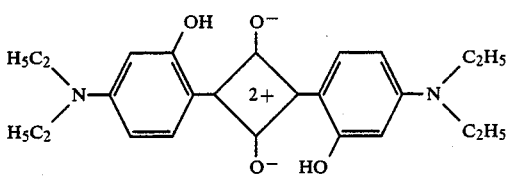
No I-10
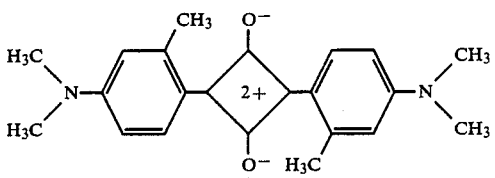

-continued
No I-11
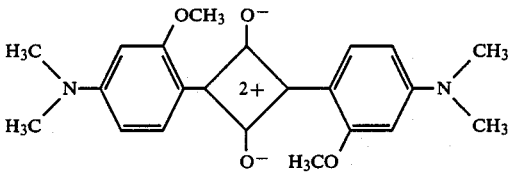
The squarylium compounds represented by the general formula (II) and to be used in the present invention include:
Compound No II-1
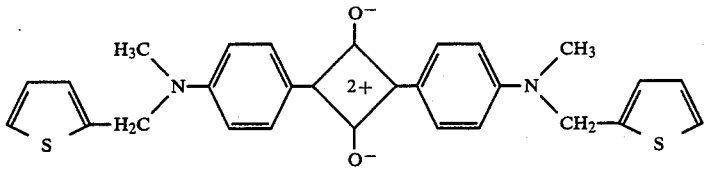
No II-2
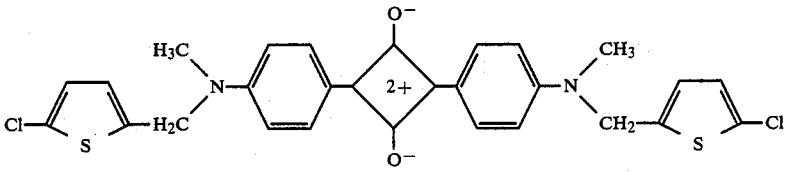
No II-3
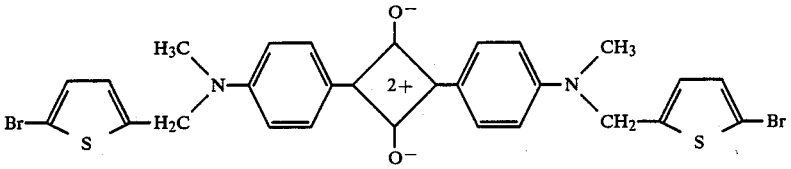
No II-4
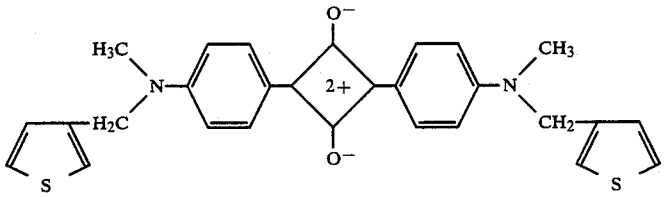
No II-5
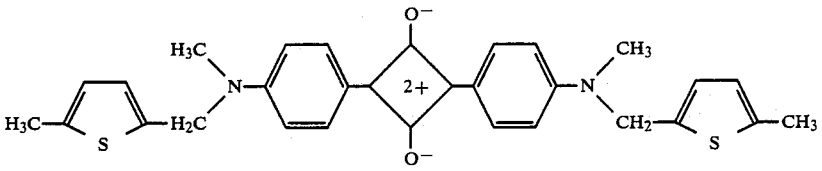
No II-6
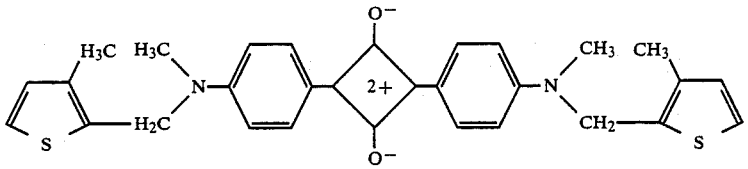
No II-7
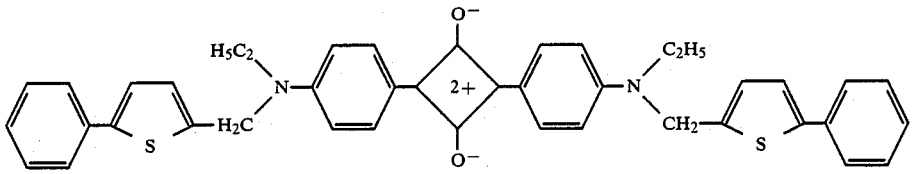

-continued

No II-8

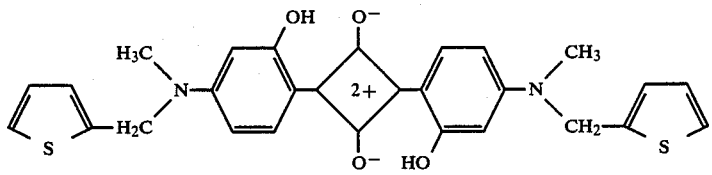

No II-9

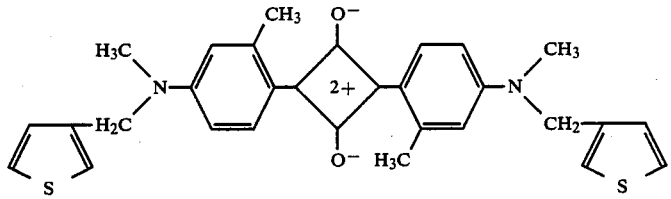

No II-10

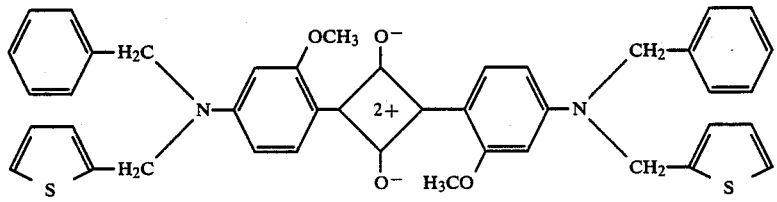

No II-11

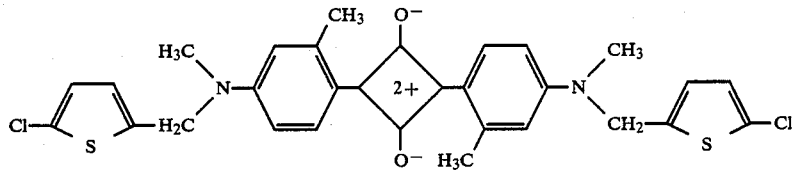

No II-12

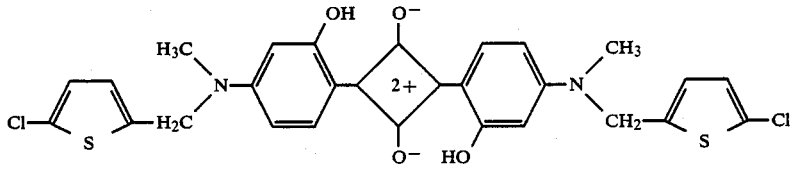

In the charge generating layer 6, a hydrazone compound is included as the charge transporting substance. It is preferable to use one of the hydrazone compound represented by the following general formula (III).

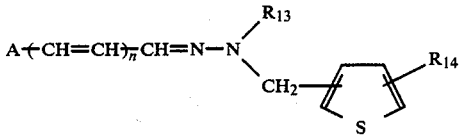

(III)

Wherein, A stands for one of an aryl group and a hetelocyclic group, both of which may be or not may be substituted, R13 stands for one of an alkyl group and an aryl group, both of which may be or not may be substituted, R14 stands for one of a hydrogen atom, a halogen atom, an alkyl group and an aryl group, both of which groups may be or not may be substituted and n stands for one integer of 0 or 1.

The hydrazone compound represented by the general formula (III) are synthesized by, for example, dehydration condensation reacting a corresponding carbonyl compound A-(-CH=CH-)-CHO with a hydrazine

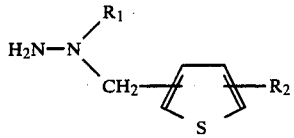

in an alcohol such as ethanol and the presence of a small amount of hydrochloric acid as a catalyst.

The hydrazone compounds represented by the general formula (III) include:

Compound

-continued
No III-1
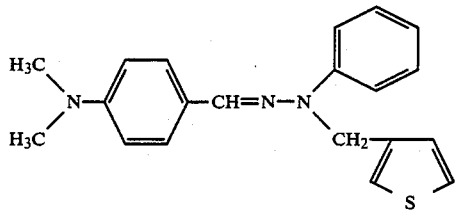
No III-2
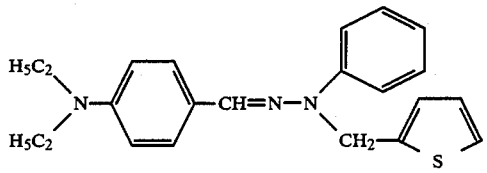
No III-3
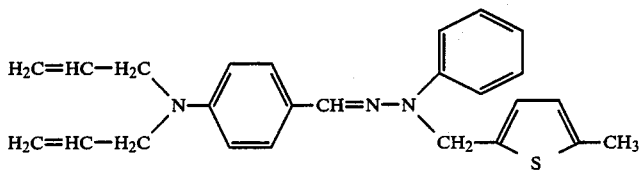
No III-4
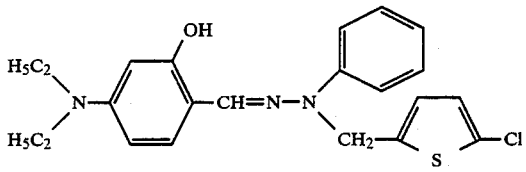
No III-5
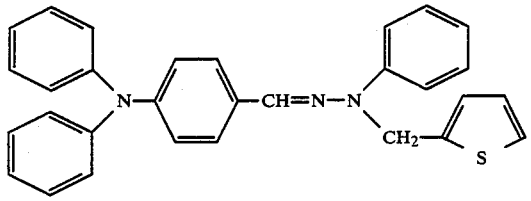
No III-6
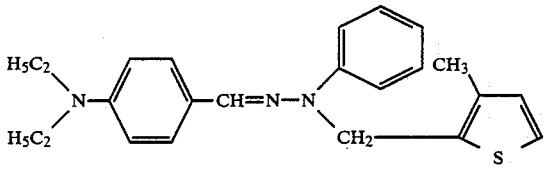
No III-7
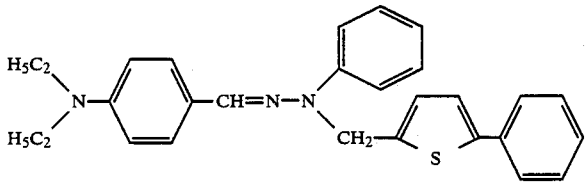
No III-8
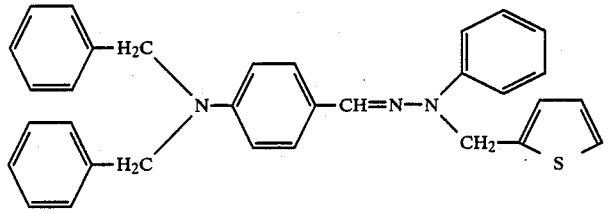

-continued
No III-9
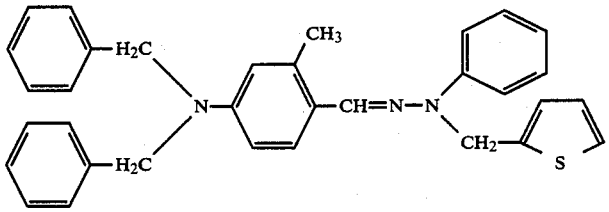
No III-10
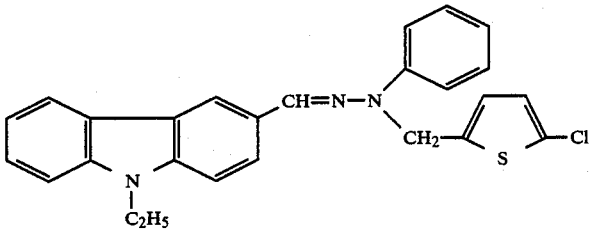
No III-11
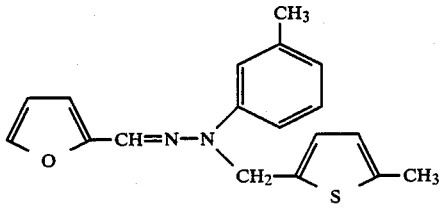
No III-12
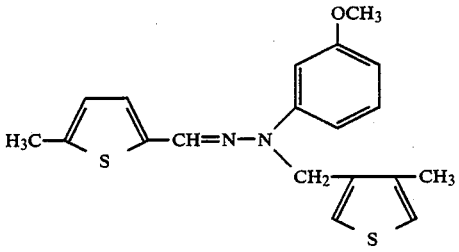
No III-13
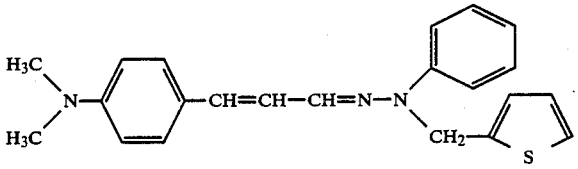
No III-14
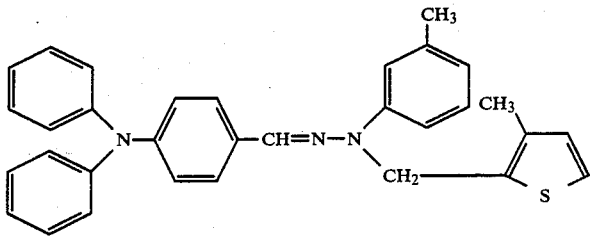
No III-15
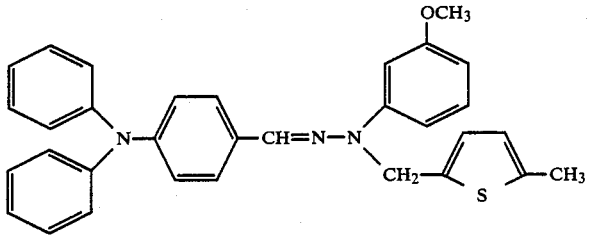

-continued
No III-16
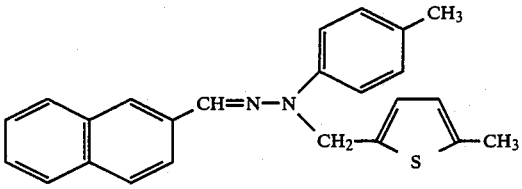
No III-17
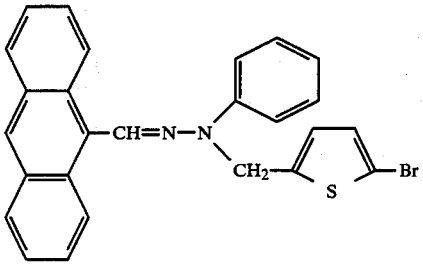
No III-18
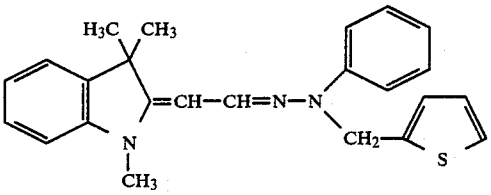
No III-19
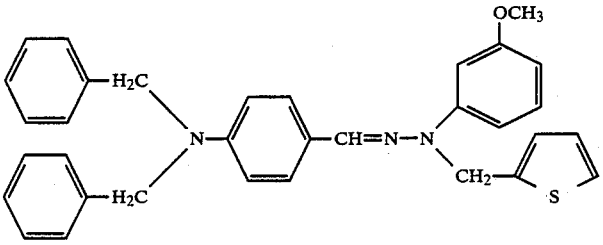
Further, other hydrazone compounds which are not represented by the general formula (III) but to be used as the charge transporting substace in the present invention include:
Compound No IV-1
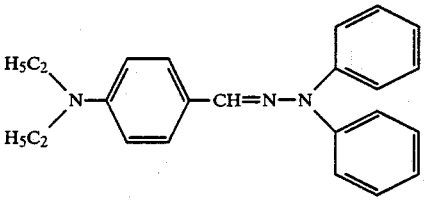
No IV-2
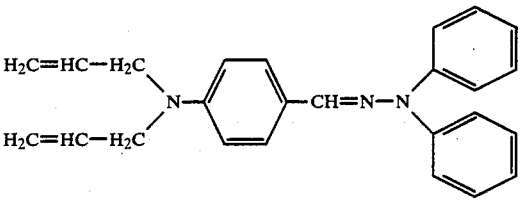
-continued
No IV-3
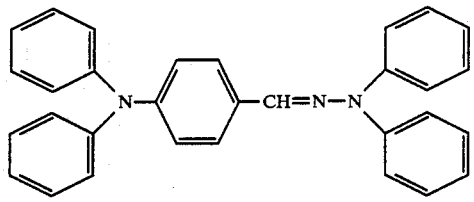
No IV-4
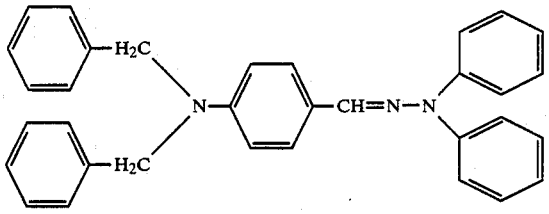
No IV-5
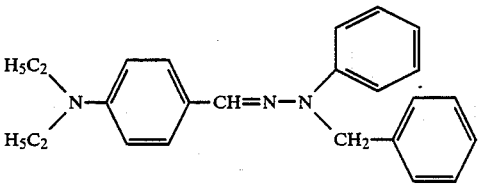

-continued

No IV-6

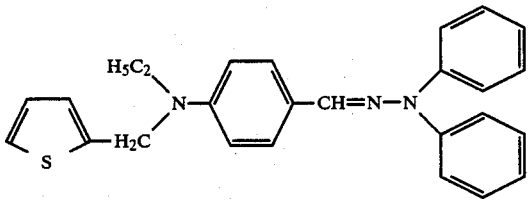

No IV-7

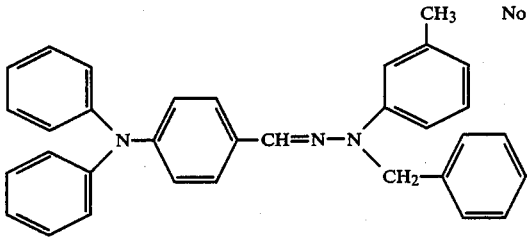

No IV-8

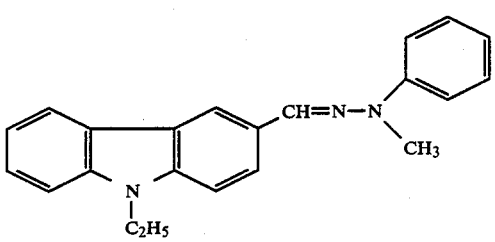

No IV-9

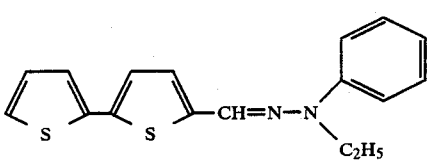

No IV-10

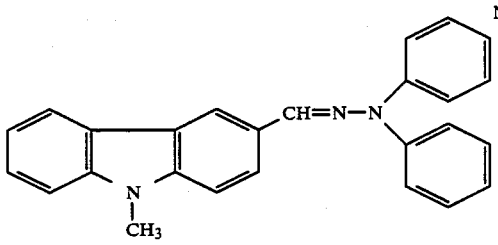

Examples will now be given, wherein the abovementioned compounds were respectively used to produce photoconductors.

EXAMPLE 1

1 part by weight of the squarylium compound No. I-1 as a charge generating substance, 1 part by weight of a vinyl chloride copolymer resin (MR-110: manufactured by Nihon Zeon Co., Ltd.) and 150 parts by weight of ethyl acetate were kneaded with a mixer for 3 hours to prepare a coating liquid for a charge generating layer. Subsequently, 1 part by weight of the hydrazone compound No. III-2 as a charge transporting substance and 1 part by weight of a polycarbonate resin (Panlite L-1225: manufactured by Teijin Kasei Co., Ltd.) as a binder were solved into 6 parts by weight of dichloromethane to prepare a coating liquid for the charge transporting layer. The coating liquid for the charge generating layer was applied onto an aluminum-deposited polyester film (Al—PET) as an electroconductive substrate to form the charge generating layer having a dry thickness of 1 μm. Further, the coating liquid for the charge transporting layer was applied on the charge generating layer to form the charge transporting layer having a dry thickness of 15 μm. Thus, a photoconductor as shown in FIG. 1 was produced.

EXAMPLES 2-20

Photoconductors of examples 2-20 were produced in the same manner as in Example 1 except that the compounds as the charge generating substance and the charge transporting substance were replaced by the compounds as shown in Table 1, respectively.

COMPARATIVE EXAMPLES 1-4

For comparison, photoconductors were produced in the same manner as in Example 1 except that respective compounds as shown in Table 1 were used as the charge generating substance and the charge transporting substance instead of compound Nos. I-1 and III-2.

TABLE 1

| | Charge Generating Substance Compound No. | Charge Transporting Substance Compound No. |
|---|---|---|
| Example No. | | |
| 1 | I-1 | III-2 |
| 2 | I-1 | III-3 |
| 3 | I-1 | III-5 |
| 4 | I-1 | III-8 |
| 5 | I-1 | III-9 |
| 6 | I-5 | III-2 |
| 7 | I-5 | III-3 |
| 8 | I-5 | III-5 |
| 9 | I-5 | III-8 |
| 10 | I-5 | III-9 |
| 11 | I-7 | III-2 |
| 12 | I-7 | III-3 |
| 13 | I-7 | III-5 |
| 14 | I-7 | III-8 |
| 15 | I-7 | III-9 |
| 16 | I-8 | III-2 |
| 17 | I-8 | III-3 |
| 18 | I-8 | III-5 |
| 19 | I-8 | III-8 |
| 20 | I-8 | III-9 |
| Comparative Example No. | | |
| 1 | I-1 | ASPP |
| 2 | I-1 | ABPH |
| 3 | ε-copper phthalocyanine | ASPP |
| 4 | ε-copper phthalocyanine | ABPH |

In Table 1, ASPP is 1-phenyl-3-(P-diethylaminostyryl)-5-(paradiethyl-aminophenyl)-2-pyrazoline and ABPH is p-diethylaminobenzaldehyde-diphenylhydrazone.

The electrophotographic characteristics of the photoconductors thus produced were measured by utilizing an electrostatic recording paper testing apparatus (Kawaguchi Denki Model SP-428).

The surface potential Vs (volts) of each photoconductor is an initial surface potential which was measured when the surface of the photoconductor was negatively charged in the dark by corona discharge at −6.0 kV for 10 seconds. After the discontinuation of the corona discharge, the photoconductor was allowed to stand in the dark for 2 seconds, after which the surface potential Vd (volts) of the photoconductor was measured. Subsequently, the surface of the photoconductor was irradiated with monochromatic light (wavelength 780 mm) of 1 μW and the time (seconds) required for the irradiation to decrease the surface potential of the photoconductor to half of the Vd was measured, then from which time and the illuminance the half decay exposure amount $E_{\frac{1}{2}}$ (lux.sec) was calculated. Also, the surface potential of the photoconductor after 10 seconds of irradiation thereof with the monochromatic light of 1 μW was measured as a residual potential Vr (volts).

Further, the electrophotographic characteristics of the photoconductors were measured by using white light because a high sensitivity could be expected for white light. That is, Vs and VD of each photoconductor were measured in the same manner as described above, and the half decay exposure amount $E_{\frac{1}{2}}$ (lux.sec) was found by irradiation of the photoconductor surface with white light at an illuminance of 2 lux, while residual potential Vr (volts) was measured after 10 seconds of irradiation of the photoconductor surface with the above-mentioned light.

The results obtained are shown in Table.

TABLE 2

| | Monochromatic Light | | | White Light | | |
|---|---|---|---|---|---|---|
| | Vs (volt) | Vr (volt) | $E_{\frac{1}{2}}$ (μJ/cm²) | Vs (volt) | Vr (volt) | $E_{\frac{1}{2}}$ (lux · sec) |
| Example No. | | | | | | |
| 1 | −680 | −50 | 0.82 | −660 | −60 | 1.42 |
| 2 | −700 | −50 | 0.84 | −690 | −55 | 1.28 |
| 3 | −675 | −55 | 0.79 | −700 | −60 | 1.25 |
| 4 | −710 | −45 | 0.78 | −720 | −55 | 1.30 |
| 5 | −720 | −60 | 0.75 | −700 | −65 | 1.34 |
| 6 | −695 | −65 | 0.90 | −680 | −75 | 1.31 |
| 7 | −700 | −50 | 0.91 | −710 | −55 | 1.28 |
| 8 | −685 | −45 | 0.92 | −670 | −55 | 1.30 |
| 9 | −670 | −60 | 0.87 | −690 | −70 | 1.39 |
| 10 | −720 | −65 | 0.84 | −700 | −65 | 1.41 |
| 11 | −720 | −60 | 0.84 | −700 | −75 | 1.32 |
| 12 | −650 | −55 | 0.83 | −685 | −65 | 1.35 |
| 13 | −630 | −60 | 0.87 | −650 | −60 | 1.39 |
| 14 | −620 | −50 | 0.80 | −660 | −70 | 1.29 |
| 15 | −640 | −45 | 0.90 | −635 | −65 | 1.36 |
| 16 | −675 | −45 | 0.80 | −690 | −55 | 1.28 |
| 17 | −680 | −55 | 0.81 | −670 | −65 | 1.29 |
| 18 | −670 | −40 | 0.80 | −665 | −60 | 1.25 |
| 19 | −660 | −50 | 0.85 | −690 | −65 | 1.30 |
| 20 | −650 | −55 | 0.84 | −680 | −60 | 1.31 |
| Comparative Example No. | | | | | | |
| 1 | −675 | −75 | 1.20 | −685 | −85 | 1.65 |
| 2 | −710 | −65 | 1.05 | −700 | −80 | 1.45 |
| 3 | −685 | −85 | 1.49 | −690 | −100 | 2.01 |
| 4 | −725 | −75 | 1.39 | −670 | −90 | 1.89 |

As can be seen in Table 2, Examples 1 to 20 are substantially the same as Comparative examples 1 to 4 in the surface potential Vs, however Example 1 to 20 are superior in the residual potential Vr and half decay exposure amounts $E_{\frac{1}{2}}$. Hence, the electrophotographic characteristics are improved by combining the squarylium compound as the charge generating substance and the hydrazone compound as the charge transporting substance in accordance with the present invention.

EXAMPLE 21

1 part by weight of the squarylium compound No. I-8 as the charge generating substance, 2 parts by weight of a polyester resin (Vylon 200, manufactured by Toyobo Co., Ltd.) as a binder and 300 parts by weight of dichloromethane were kneaded with a mixer for 3 hours to prepare a coating liquid for the charge generating layer. Subsequently, 1 part by weight of the hydrazone compound No. III-2 as a charge transporting substance and 1.5 parts by weight of polyarylate (U-polyer U-100A, manufactured by Unitika Ltd.) as a binder were solved into 9 parts by weight of dichloromethane to prepare a coating liquid for the charge transporting layer. The coating liquid for the charge transporting layer was applied onto an aluminum deposited polyesterlerephthalate film to form the charge transporting layer having a dry thickness of 15 μm. Further, the coating liquid for the charge generating layer was applied onto the charge transporting layer to form the charge generating layer having a dry thickness of 1 μm. Thus, a photoconductor as shown in FIG. 2 was produced. However, the covering layer, which is not essential in the present invention, was not provided.

EXAMPLES 22–25

Photoconductors of Examples 22 to 25 were produced in the same manner as in Example 21 except that the compounds as the charge generating substance and the charge transporting substance were replaced by the compounds, respectively, as shown in Table 3.

COMPARATIVE EXAMPLES 5–8

Photoconductors were produced in the same manner as in Example 21 except that respective compounds as shown in Table 3 were used as the charge generating substance and the charge transporting substance instead of the compound Nos. I-8 and III-2.

TABLE 3

| Example No. | Charge Generating Substance Compound No. | Charge Transporting Substance Compound No. |
|---|---|---|
| 21 | I-8 | III-2 |
| 22 | I-8 | III-3 |
| 23 | I-8 | III-5 |
| 24 | I-8 | III-8 |
| 25 | I-8 | III-9 |
| Comparative Example No. | | |
| 5 | I-8 | ASPP |
| 6 | I-8 | ABPH |
| 7 | ε-copper phthalocyanine | ASPP |
| 8 | ε-copper phthalocyanine | ABPH |

The electrophotographic characteristics of the photoconductors thus produced were measured with the testing apparatus SP-428. The photoconductors are positively charged at +6.0 kV for 10 seconds, the other measuring conditions are the same as mentioned before.

The results obtained are shown in Table 4.

TABLE 4

| | Monochromatic Light | | | White Light | | |
|---|---|---|---|---|---|---|
| | Vs (volt) | Vr (volt) | $E_{\frac{1}{2}}$ (μJ/cm²) | Vs (volt) | Vr (volt) | $E_{\frac{1}{2}}$ (lux · sec) |
| Example No. | | | | | | |
| 21 | 715 | 60 | 0.94 | 700 | 65 | 1.42 |
| 22 | 750 | 55 | 0.92 | 675 | 60 | 1.35 |
| 23 | 730 | 50 | 0.97 | 670 | 55 | 1.40 |
| 24 | 705 | 50 | 0.90 | 710 | 60 | 1.41 |
| 25 | 690 | 55 | 0.88 | 705 | 65 | 1.38 |

TABLE 4-continued

| | Monochromatic Light | | | White Light | | |
|---|---|---|---|---|---|---|
| | Vs (volt) | Vr (volt) | $E_{\frac{1}{2}}$ ($\mu J/cm^2$) | Vs (volt) | Vr (volt) | $E_{\frac{1}{2}}$ (lux · sec) |
| Comparative Example No. | | | | | | |
| 5 | 675 | 75 | 1.25 | 660 | 85 | 1.75 |
| 6 | 660 | 60 | 1.09 | 685 | 70 | 1.53 |
| 7 | 715 | 85 | 1.59 | 665 | 95 | 2.22 |
| 8 | 695 | 75 | 1.44 | 710 | 90 | 2.04 |

As can be seen in Table 4, Examples 21 to 25 are substantially the same as Comparative examples 5 to 8 in the surface potential Vs, however Examples 21 to 25 are superior in the residual potential Vr and half decay exposure amounts $E_{\frac{1}{2}}$. Hence, the electrophotographic characteristics are improved by combining the squarylium compound as the charge generating substance and the hydrazone compound as the charge transporting substance in accordance with the present invention.

EXAMPLES 26–45

Photoconductors of Examples 26 to 45 were produced in the same manner as in Example 1 except that the compounds as the charge generating substance and the charge transporting substance were replaced by the compounds, respectively, as shown in Table 5.

COMPARATIVE EXAMPLES 9, 10

Photoconductors were produced in the same manner as in Example 26 except that respective compounds as shown in Table 5 were used as the charge generating substance instead of the compound No. II-1.

TABLE 5

| | Charge Generating Substance Compound No. | Charge Transporting 108 Substance Compound No. |
|---|---|---|
| Example No. | | |
| 26 | II-1 | IV-1 |
| 27 | II-1 | IV-2 |
| 28 | II-1 | IV-3 |
| 29 | II-1 | IV-5 |
| 30 | II-1 | III-5 |
| 31 | II-2 | IV-1 |
| 32 | II-2 | IV-2 |
| 33 | II-2 | IV-3 |
| 34 | II-2 | IV-5 |
| 35 | II-2 | III-5 |
| 36 | II-8 | IV-1 |
| 37 | II-8 | IV-2 |
| 38 | II-8 | IV-3 |
| 39 | II-8 | IV-5 |
| 40 | II-8 | III-5 |
| 41 | II-12 | IV-1 |
| 42 | II-12 | IV-2 |
| 43 | II-12 | IV-3 |
| 44 | II-12 | IV-5 |
| 45 | II-12 | III-5 |

TABLE 5-continued

| | Charge Generating Substance Compound No. | Charge Transporting 108 Substance Compound No. |
|---|---|---|
| Comparative Example No. | | |
| 9 | perylen pigment | IV-1 |
| 10 | ε-copper phthalocyanine | IV-1 |

The perylen pigment of comparative example in Table 5 is a pigment having the following structural formula.

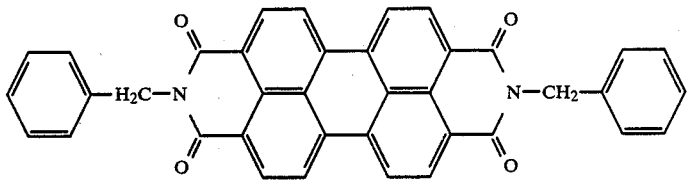

The electrophotographic characteristics of the photoconductors thus produced are measured in the same manner as in Example 1.

The results obtained are shown in Table. 6.

TABLE 6

| | Monochromatic Light | | | White Light | | |
|---|---|---|---|---|---|---|
| | Vs (volt) | Vr (volt) | $E_{\frac{1}{2}}$ ($\mu J/cm^2$) | Vs (volt) | Vr (volt) | $E_{\frac{1}{2}}$ (lux · sec) |
| Example No. | | | | | | |
| 26 | −650 | −50 | 0.70 | −680 | −60 | 1.20 |
| 27 | −665 | −55 | 0.73 | −660 | −65 | 1.25 |
| 28 | −670 | −50 | 0.68 | −675 | −60 | 1.11 |
| 29 | −690 | −60 | 0.74 | −700 | −65 | 1.21 |
| 30 | −665 | −50 | 0.77 | −680 | −60 | 1.12 |
| 31 | −665 | −55 | 0.74 | −660 | −60 | 1.26 |
| 32 | −660 | −60 | 0.70 | −680 | −70 | 1.27 |
| 33 | −680 | −50 | 0.67 | −690 | −55 | 1.15 |
| 34 | −675 | −65 | 0.72 | −700 | −65 | 1.25 |
| 35 | −670 | −55 | 0.69 | −680 | −70 | 1.16 |
| 36 | −690 | −50 | 0.67 | −700 | −65 | 1.25 |
| 37 | −675 | −50 | 0.70 | −710 | −65 | 1.25 |
| 38 | −695 | −55 | 0.69 | −680 | −70 | 1.18 |
| 39 | −700 | −55 | 0.73 | −685 | −75 | 1.25 |
| 40 | −680 | −55 | 0.70 | −670 | −65 | 1.20 |
| 41 | −680 | −55 | 0.69 | −690 | −60 | 1.26 |
| 42 | −700 | −60 | 0.69 | −700 | −75 | 1.28 |
| 43 | −710 | −55 | 0.75 | −685 | −70 | 1.20 |
| 44 | −690 | −55 | 0.72 | −700 | −65 | 1.27 |
| 45 | −680 | −60 | 0.69 | −710 | −70 | 1.19 |
| Comparative Example No. | | | | | | |
| 9 | — | — | — | −700 | −120 | 2.45 |
| 10 | −670 | −80 | 1.39 | −670 | −100 | 1.75 |

As can be seen in Table 6, Examples 26 to 45 are substantially the same as Comparative examples 9 and 10 in the surface potential Vs, however Examples 26 to 45 are superior in the residual potential Vr and half decay exposure amounts $E_{\frac{1}{2}}$. Hence, the electrophotographic characteristics are improved by combining the squarylium compound as the charge generating substance and the hydrazone compound as the charge transporting substance in accordance with the present invention.

EXAMPLES 46–50

Photoconductors of Examples 46 to 50 were produced in the same manner as in Example 21 except that the compounds as the charge generating substance and the charge transporting substance were replaced by the compounds, respectively, as shown in Table 7.

COMPARATIVE EXAMPLES 11, 12

Photoconductors were produced in the same manner as in Example 46 except that respective compounds as shown in Table 7 were used as the charge generating substance instead of the compound Nos. II-8.

TABLE 7

| | Charge Generating Substance Compound No. | Charge Transporting Substance Compound No. |
|---|---|---|
| Example No. | | |
| 46 | II-8 | IV-1 |
| 47 | II-8 | IV-2 |
| 48 | II-8 | IV-3 |
| 49 | II-8 | IV-5 |
| 50 | II-8 | III-5 |
| Comparative Example No. | | |
| 11 | perylene pigment | IV-1 |
| 12 | ε-copper phthalocyanine | IV-1 |

The perylene pigment of Comparative example 11 is the same as that of Comparative example shown in Table 5.

The electrophotographic characteristics of the photoconductors thus obtained were measured in the same manner as in Example 21. The results obtained are shown in Table 8.

TABLE 8

| | Monochromatic Light | | | White Light | | |
|---|---|---|---|---|---|---|
| | Vs (volt) | Vr (volt) | $E\frac{1}{2}$ ($\mu J/cm^2$) | Vs (volt) | Vr (volt) | $E\frac{1}{2}$ (lux · sec) |
| Example No. | | | | | | |
| 46 | 700 | 60 | 0.87 | 710 | 75 | 1.35 |
| 47 | 680 | 60 | 0.81 | 690 | 70 | 1.36 |
| 48 | 660 | 65 | 0.79 | 680 | 70 | 1.27 |
| 49 | 670 | 70 | 0.83 | 665 | 75 | 1.32 |
| 50 | 690 | 55 | 0.83 | 705 | 65 | 1.29 |
| Comparative Example No. | | | | | | |
| 11 | — | — | — | 700 | 125 | 2.70 |
| 12 | 690 | 85 | 1.44 | 710 | 100 | 2.05 |

As can be seen in Table 8, Examples 46 to 50 are substantially the same as Comparative examples 11 and 12 in the surface potential Vs, however Examples 46 to 50 are superior in the residual potential Vr and half decay exposure amounts $E\frac{1}{2}$. Hence, the electrophotographic characteristics are improved by combining the squarylium compound as the charge generating substance and the hydrazone compound as the charge transporting substance in accordance with the present invention.

As described above, according to the present invention, since a squarylium compound represented by any one of the aforementioned chemical formulae is used in a charge generation layer as a charge generating substance, and a hydrazone compound is used in a charge transporting layer as a charge transporting substance, a photoconductor shows a high sensitive and excellent characteristics in repeated use when adapted to either a positive charge mode or a negative charge mode. If necessary, a covering layer may be provided on the surface of a photoconductor to improve the durability thereof.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A photoconductor for electrophotography, comprising:

an electrically conductive substrate; and a laminate formed on said substrate and including a charge generating layer and a charge transporting layer;

wherein said charge generating layer includes at least one squarylium compound represented by the following general formula (II) as a charge generating substance:

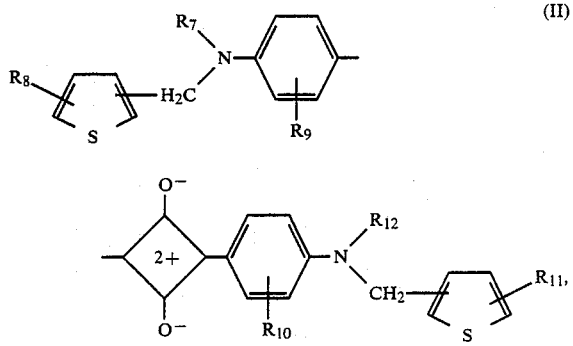

(II)

wherein each of R7 and R12 stands for one of an alkyl group, an aryl group, an aralkyl group, and an alkenyl group, each of which groups may be or may not be substituted, each of R8 and R11 stands for one of a hydrogen atoms, a halogen atom, an alkyl group and an aryl group, both of which groups may be or may not be substituted, and each of R9 and R10 stands for one of a hydrogen atom, a halogen atom, a hydroxy group, an alkyl group and an alkoxy group; and wherein said charge transporting layer includes at least one hydrazone compound represented by the following general formula (III) as a charge transporting substance:

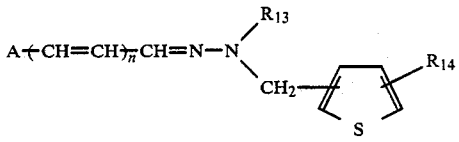

(III)

wherein A stands for one of an aryl group and a hetelocyclic group, both of which may be or may not be substituted, R13 stands for one of an alkyl group and an aryl group, both of which may be or may not be substituted, R14 stands for one of a hydrogen atom, a halogen atom, an alkyl group and an aryl group, both of which groups may be or may not be substituted and n stands for an integer which is 0 or 1.

2. The photoconductor for electrophotography as claimed in claim 1, wherein said charge generating layer is formed on said substrate and said charge transporting layer is formed on said charge generating layer.

3. The photoconductor for electrophotography as claimed in claim 1, wherein said charge transporting layer is formed on said substrate and said charge generating layer is formed on said charge transporting layer.

* * * * *